United States Patent [19]

Hueber et al.

[11] Patent Number: 4,892,982

[45] Date of Patent: Jan. 9, 1990

[54] TIMING MECHANISM WITH IMPROVED CLUTCH ASSEMBLY

[75] Inventors: William J. Hueber, Brownsburg; Robert L. Eder, Speedway; R. Keith Cearlock, Frankfort, all of Ind.

[73] Assignee: Emhart Industries, Inc., Indianapolis, Ind.

[21] Appl. No.: 189,326

[22] Filed: May 2, 1988

Related U.S. Application Data

[63] Continuation-in-part of Ser. No. 106,999, Oct. 5, 1987, abandoned, which is a continuation-in-part of Ser. No. 5,015, Oct. 20, 1987, abandoned, and a continuation-in-part of Ser. No. 124,493, Nov. 23, 1987, abandoned.

[51] Int. Cl.[4] ..... H01H 43/00

[52] U.S. Cl. ..... 200/38 R; 200/38 A; 200/38 B; 200/38 C

[58] Field of Search ..... 200/33 R, 35 R, 37 A, 200/38 R, 38 A, 38 F, 38 FA, 38 FB, 38 B, 38 BA, 38 C, 38 CA; 74/568 T

[56] References Cited

U.S. PATENT DOCUMENTS

| | | | |
|---|---|---|---|
| 4,146,760 | 3/1979 | Voland | 200/38 A |
| 4,307,270 | 12/1981 | Smock | 200/38 R |
| 4,412,110 | 10/1983 | Wojtarek | 200/38 C X |
| 4,497,985 | 2/1985 | Courter et al. | 200/38 R |
| 4,497,986 | 2/1985 | Zink et al. | 200/38 R |
| 4,796,484 | 1/1989 | Eder | 200/38 R X |

*Primary Examiner*—J. R. Scott

*Attorney, Agent, or Firm*—Carl A. Forest

[57] ABSTRACT

A clutch assembly permits a manual setting of a timing mechanism camstack by an appliance operator and at the same time insures that the camstack cannot be manually set during the time that electrical power is being supplied to the timing mechanism. The assembly includes a support and a camstack, a shaft and a bearing mounted in the support for rotation about a common axis. First clutch teeth are integrally formed within the bearing and second clutch teeth are integrally formed within the shaft. The bearing is mechanically coupled to the camstack via tangs on the camstack which pass through channels in the bearing. The shaft is axially movable from a first position in which the first and second teeth are engaged to a second position in which the teeth are disengaged. The ends of the teeth are formed and arranged so that no matter what relative rotational position about the axis the first teeth are with respect to the second teeth when the shaft is moved axially from the second position toward the first position, the teeth will engage.

12 Claims, 3 Drawing Sheets

TIMING MECHANISM WITH IMPROVED CLUTCH ASSEMBLY

This application is a continuation-in-part of application Ser. No. 106/999, filed 10-5-87, now abandoned, which itself was a continuation of application Ser. No. 005,015, filed 1-20-87, now abandoned. This application is also a continuation - in part of application Ser. No. 124,493 filed Nov. 23, 1987, now abandoned.

BACKGROUND OF THE INVENTION

1. Field of the Invention

The present invention relates to timing mechanism having a clutch assembly that is operable in conjunction with a power line switch which shuts off electrical power to the timing mechanism during manual setting of the camstack.

2. Description of the Prior Art

Timing mechanisms for appliances such as washing machines generally employ a timing cam or camstack which is advanced in a step-by-step manner to program the appliance. The camstack can be manually set through a clutch by the appliance operator; however, during such manual setting all power to the timing mechanism should be shut off. In order to accomplish this, line switches are used in conjunction with the clutch to be oipened during manual setting of the camstack. The present invention pertains to such an arrangement which has a minimum number of parts and thus is easier and less expensive to produce.

SUMMARY OF THE INVENTION

Accordingly, there is provided a timing mechanism which in general comprises: a support and a camstack, a shaft, first clutch teeth, and second clutch teeth all mounted in the support for rotation about a common axis, the shaft movable along the axis between a first-position and a second position; first switch means for contacting the camstack to be actuated thereby; the first clutch teeth mechanically coupled to the camstack so that when one rotates the other also rotates; the second clutch teeth integrally formed with the shaft; the shaft, the first teeth, and the second teeth located so that when the shaft is in the first position, the first teeth are engaged with the second teeth and when the shaft is in the second position, the first teeth and the second teeth are disengaged; and the ends of the first and second teeth formed and arranged so that no matter what relative rotational positions about the axis the first teeth are with respect to the second teeth, when the shaft is moved axially from the second position toward the first position the teeth will intermesh. Preferably, one of either the first teeth or the second teeth have their tips rounded on all sides. Preferably one of either the first teeth or the second teeth have spherical ends. Preferably, the other of the first teeth or the second teeth have v-shaped ends with rounded leading edges. Preferably, the timing mechanism further comprises second switch means for controlling power to the timing mechanism, and switch actuating means mounted on the shaft for activating the second switch means. Preferably the shaft includes a circumferential grrove, the actuating means includes spring fingers, and the actuating means is coupled to the shaft by the spring fingers fitting into the groove. Preferably, the camstack includes a hollow hub having tangs extending in the hollow hub parallel to the axis, and the timing mechanism further includes a bearing mounted in the support and having channels through it, the first clutch teeth are integrally formed with the bearing and are mechanically coupled to the camstack by the tangs passing through the channels.

In another aspect of the invention, the shaft includes a narrower portion having threads and an enlarged portion having a groove and the switch actuating means includes a resilient means for engaging the groove, the enlarged portion having a diameter greater than the major diameter of the threads and the resilient means having a diameter equal to or greater than the major diameter of the threads and less than the diameter of the enlarged portion whereby the switch actuator means can be slid onto said shaft with the resilient means passing over the threads without damage and engaging the groove in the enlarged portion to couple the actuating means to said shaft. Preferably the shaft further includes a ramp portion connecting the narrower portion and said enlarged portion. Preferably the resilient means comprises a plurality of resilient figures arranged in a circle of diameter greater than or equal to the major diameter of the threads.

DESCRIPTION OF THE PREFERRED EMBODIMENT

Figure 1:
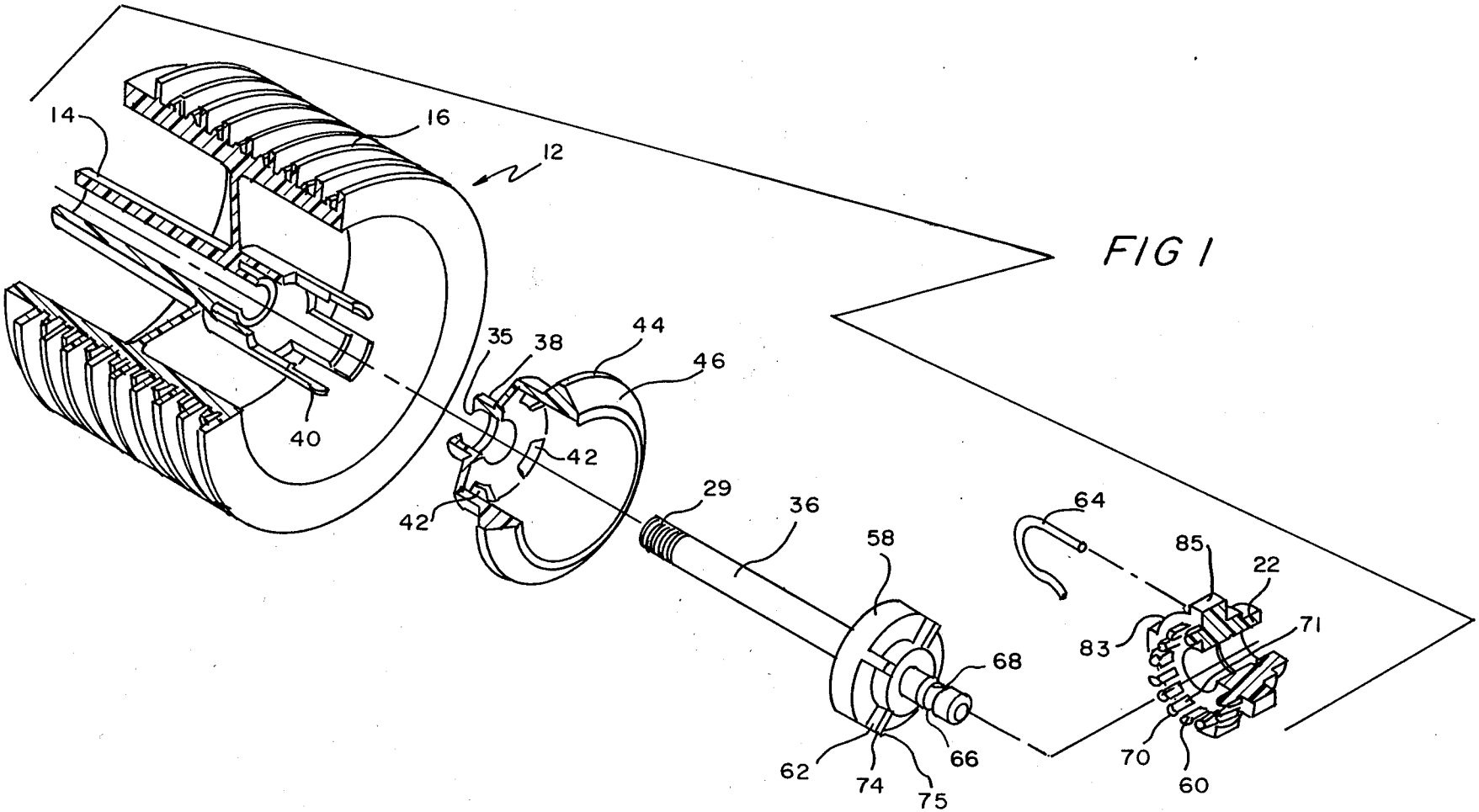
FIG. 1 is an exploded view of clutch assembly made according to the invention.

Referring now to the drawings, there is shown a timing mechanism 10 employing the invention. Timing mechanism 10, in general, includes a camstack 12 having a hollow hub portion 14 with a plurality of cam lobes on cam tracks 16 extending about the hub portion. A plurality of electrical switches 18 (one shown) engage the camstack to be opened and closed thereby. The switches open and close electrical circuits to an appliance in a manner well known in the art. A shaft 36 extends through the hub portion and is journalled for rotation within the hub and a bearing 22. Bearing 22 is carried in support 24 while hub 14 is journalled in support 26. Shaft 36 is axially movable to one of two positions. The camstack is coupled to a motor 28 for power driven rotation through gears 30 and 32, gear 32 being provided integral with the camstack.

Shaft 36 includes a narrower portion 21, an enlarged portion 23, and a ramp portion 25 connecting the two. A circular groove 27 is formed about the circumference of enlarged portion 23. Threads 29 are formed on the end 17 of the shaft. These threads comprise an attaching means 29 to attach a knob to manually operate shaft 36. The invention contemplates that attaching means other than threads may be used. The enlarged portion 23 and the groove 27 comprise an engaging means 31 for engaging switch actuator member 34. The invention contemplates that other engaging means may be used.

Switch actuating means 33 comprising line switch actuator member 34 and slider 50. Line switch actuator member 34 is independently rotatably carried on shaft 36. It is held on the shaft by a plurality of resilient "spring" fingers 38 having tips 35 which seat in groove 27 to couple the actuator 34 to the shaft 36. Groove 27 preferably has a diameter slightly larger than the circle defined by the tips 35 of fingers 38. This ensures a "snug" fit of actuator 34 on shaft 36 which prevents play which would interfere with performance. Actuator 34 is coupled to camstack 12 through tangs 40 which extend lengthwise from hollow hub 14 through openings 42 provided in actuator 34. Tangs 40 also extend through channels 83 provided by lugs 85 to couple bearing 22 to camstack 12. Actuator 34 includes ring 41 having an outer rim 44 and a ramp surface 46. As will be hereinafter discussed, an axial movement of shaft 36 causes the actuator 34 to open or close line switch 48 through a slider 50 and a follower 52 carried by movable blade 54 of the switch. Slider 50 is mounted in a slot (not shown) of support 24 and includes ramp surface 90.

Figure 3:
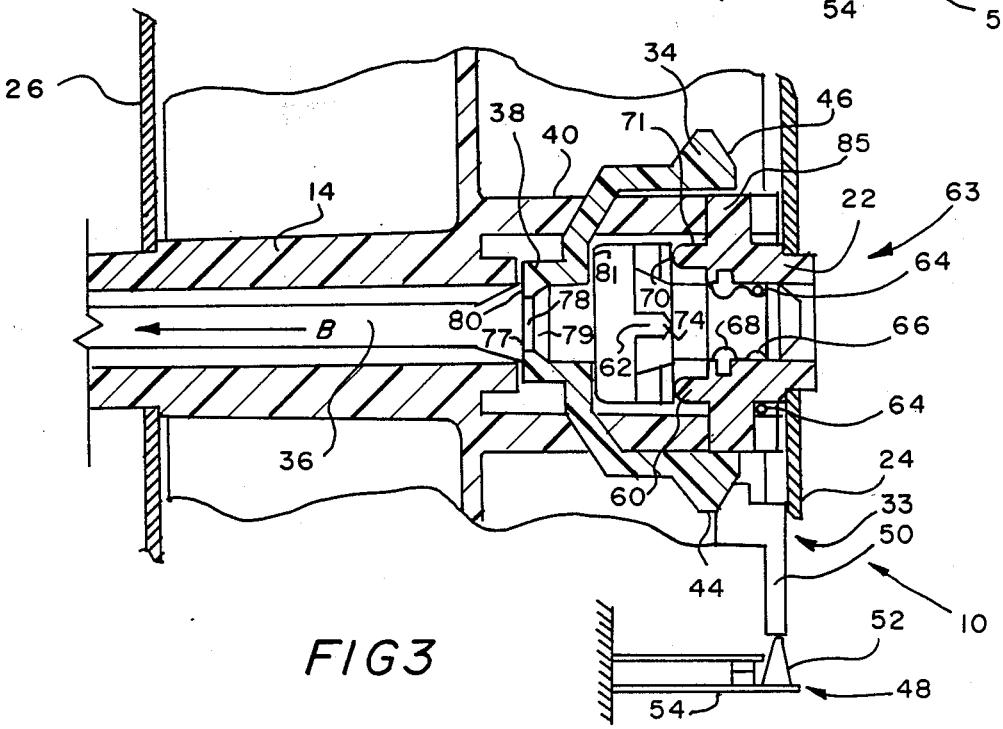

Clutch means 56 includes first clutch teeth 60 carried on bearing 22 and second clutch teeth 62 carried on member 58 fixedly carried on shaft 36. As shown in FIG. 3 first teeth 60 are preferably integrally formed with bearing 22 and second teeth 62 are preferably integrally formed with shaft 36 and member 58. Engagement of teeth 62 carried on toothed member 58 with teeth 60 permits camstack 12 to be manually set in a manner to be described.

A detent means 63 limits an axial movement of shaft 36. Detent means includes a spring 64 which engages grooves 66 and 68 of shaft 36.

Figure 2:
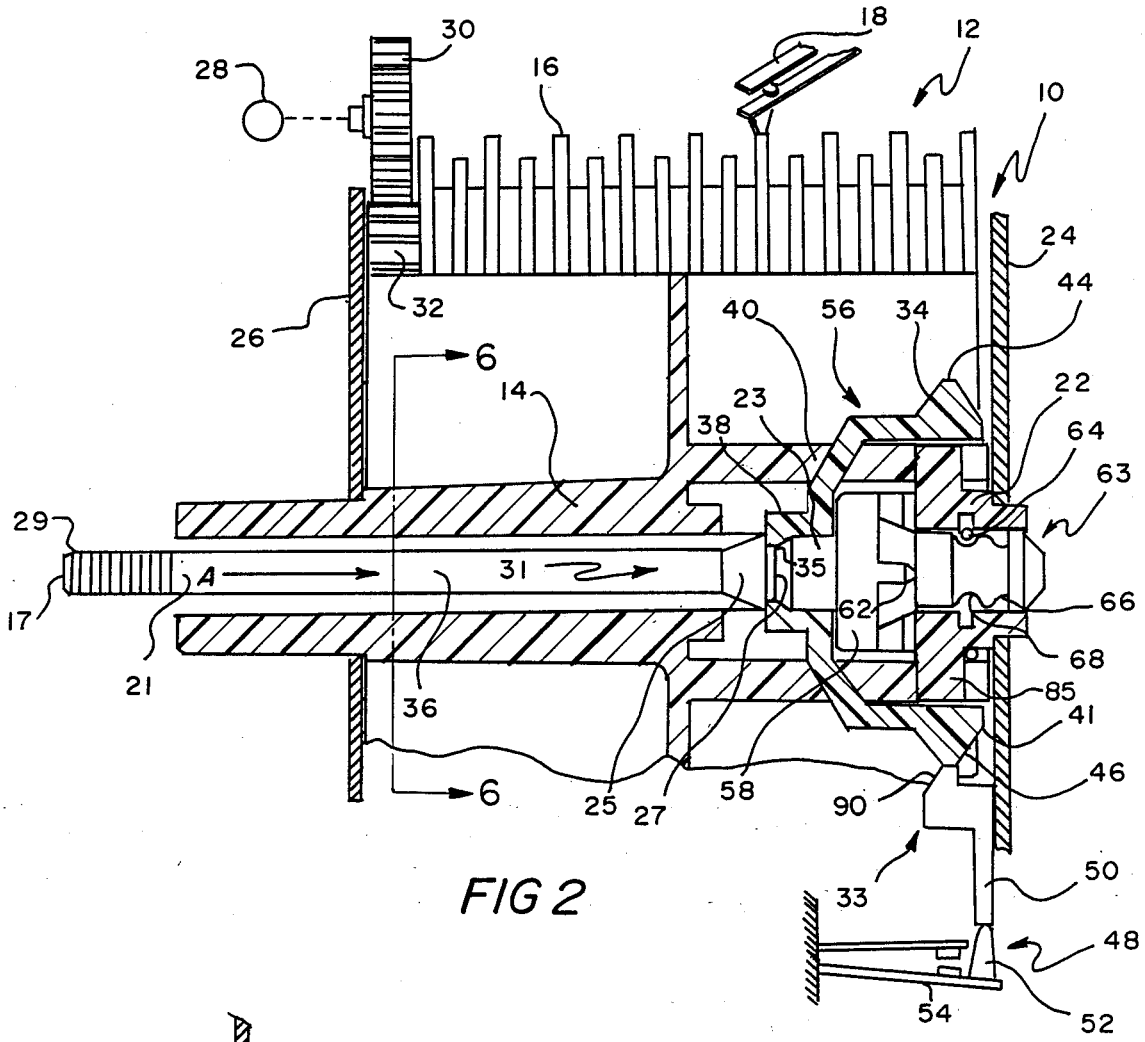
FIGS. 2 and 3 are sections of a portion of a timing mechanism using the clutch assembly of FIG. 1 in conjunction with a line switch in two different operating modes.

The operation of the clutch and line switch can now be descirbed. Referring to FIG. 2, the operating mode of the timing mechanism is shown without electrical power being applied to the timing mechanism. Shaft 36 has been axially moved inward in the direction of arrow A to move slider 50 up ramp 46 to the top of rim 44 to force switch blade 54 down and open switch 48. Teeth 62 and 60 (which are hidden by teeth 62 in FIG. 2) are engaged to permit the appliance operator to manually set the camstack through shaft 36. When the shaft 36 is moved in the direction of arrow B (FIG. 3), the slider 50 moves down actuator ramp 46 to close line switch 48 and apply electrical power to the timing mechanism. Teeth 60 and 62 are also disengaged to prevent manual rotation of camstack 12 with power applied to the timing mechanism. Camstack 12 may then be rotated by motor 28 through gears 30 and 32. Actuator 34 and bearing 22 are rotated with the camstack. Shaft 36 may also rotate with the camstack due to internal friction, though it is not directly coupled to the camstack.

Figure 4:
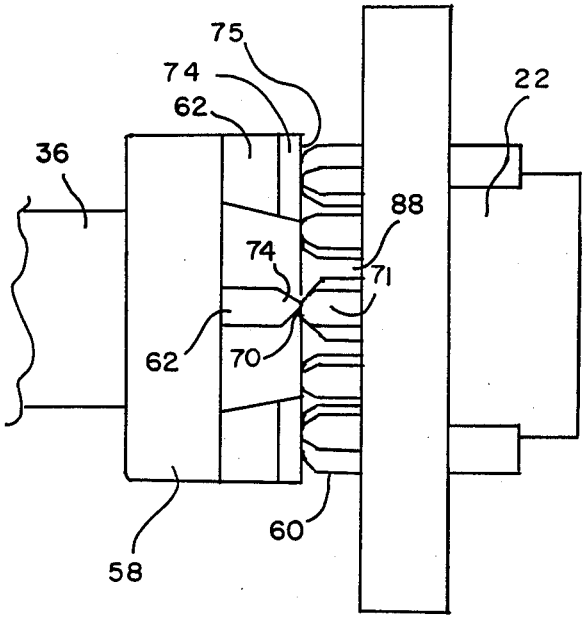
FIG. 4 is an enlarged, side view of the clutch teeth.
Figure 5:
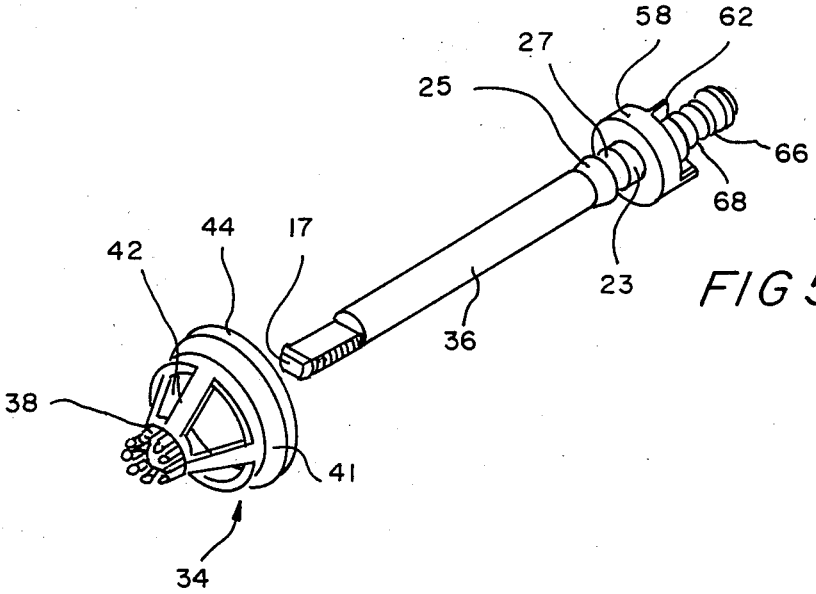
FIG. 5 is an exploded view showing details of the power line switch actuating means and the shaft.
Figure 6:
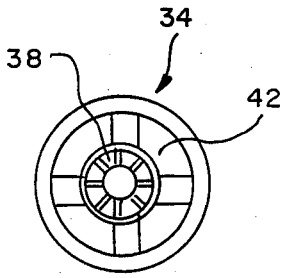
FIG. 6 is a partial cross-section and plane view of the shaft and actuator taken through line 6—6 of FIG. 2.

It is a feature of the invention that no matter in what relative rotational position about the axis of shaft 36 the first teeth 60 are with respect to second teeth 62 when shaft 36 is moved axially from the first position toward the second position, teeth 60 and teeth 62 will intermesh. In prior art clutch assemblies if the first clutch teeth were closely aligned with the second clutch teeth when the shaft was pushed in, the teeth could jam together requiring that the shaft 36 be manually rotated until they were not aligned to be pushed in. However, a consumer might continue pushing while rotation and the bearing 22 could rotate with power applied to the timing mechanism thereby rotating the camstack. However, in the assembly according to the invention, the teeth 60 and 62 are formed and arranged so that no matter in what position the teeth are in, when pressed together they will intermesh, with curvature of the tips 70 and 74 causing the shaft 36 to rotate slightly if necessary as they intermesh. As shown best in FIG. 4, teeth 60 are formed with the tips 70 rounded on all sides, preferably being spherical in shape. The base 71 of teeth 60 is preferably trapezoidal. Teeth 62 are formed with the tips 74 V-shaped, i.e. sloped on either side, as compared with the prior art in which the teeth were sloped on only one side. The leading edge 75 is then rounded within a small radius. The combination of the rounded teeth 60 and thin, rounded teeth 62 cause the teeth to slip on each other. The manufacturing tolerances are such that it is practically impossible for all of teeth 62 to be perfectly aligned with teeth 60 with the tip of each of teeth 60 at the exact center of the corresponding spherical end of each of teeth 62. Thus any force applied along the axis will create rotational forces due to the shape of the teeth which will cause the shaft 36 to turn, and the teeth will always intermesh.

It is a feature of the invention that the design of the timer shaft 36, including toothed member 58, and the actuator 34 and bearing 22 provide a clutch assembly 56 and actuating means 33 that are much simpler to manufacture than the prior art clutch assemblies and actuating means. The prior art clutch assemblies required several extra parts to provide a degree of looseness in the clutch assembly which permitted the parts to be slightly manually rotated during engagement to overcome the jamming discussed above. The integral nature of the clutch assembly of the invention provides a more solid construction than the relatively small and more numerous parts of the prior art. Moreover, there is less chance of error in order of assembly and alignment of parts with the integral construction. Thus the mechanism as a whole is less prone to breakage, jamming and other reliability problems. Likewise, the actuating means is formed with fewer parts than the prior act actuating means with the same result. The actuator 34 comprises just one self-contained part which fastens firmly in place simply by sliding it onto the shaft 36. Referring to FIG. 3 the groove 27 is formed with a flat portion 78 which has a surface parallel to the axis of the shaft 36, a shoulder 77 which is perpendicular to the axis of the shaft 36, and a sloped forward portion 79. The shape of fingers 38 conforms to the shape of the groove 27 so that they fit squarely in the groove, with the back shoulder 80 of the fingers 38 abutting the shoulder 77 of the groove. This prevents any movement of the actuator in the direction of the arrow B when the shaft 36 is moved in the direction A and the slider 50 is moving up ramp 46. When the shaft 36 is moved in the direction B, there is only little friction to be overcome between slider 50 and rimm 44 which the stiffness of the flexible fingers 38 in combination with sloped surface 79 is sufficient to overcome. Shoulder 81 of toothed member 58 may provide a stop if there is any slippage between sloped surface 79 and finger 38 when the shaft is moved in the B direction. With this design the actuator 34 must be slid over the end of 17 of shaft 36 to assemble the timer. In addition, in order for finger tips 35 to snugly fit in groove 27, they necessarily must define a circle of diameter less than the shaft portion 23 in the area of the groove 27. To prevent finger tips 35 dragging over threads 29 when actuator 34 is slipped on the shaft over end 17, the diameter defined by tips 35 is made equal to or greater than the larger diameter defined by the threads 29, i.e. the major diameter of the threads. Thus it may be slid over the threads and shaft easily. Ramp 25 is at the same angle of the forward sloped surface of fingers 38 and the fingers thus slide easily up the ramp which acts to spread fingers 38 gradually, easing their entry into the enlarged portion 23 of shaft 36. The diameter defined by enlarged portion 23 is larger than the diameter of threads 29 and the diameter defined by tips 35 of finger 38, and thus fingers 38 snap into groove 27 when the actuator reaches its desired position, to firmly engage the shaft. A further feature of the invention is that enlarged portion 23 allows the inner diameter of groove 27 to be larger compared to the groove that would be placed in the portion 21 of shaft 26 and thus leads to the strengthening of the shaft 36 in the area of greatest stress. This also permits fingers 38 to be larger and stronger for a given size of the portion 21 of shaft 36. Still another feature of the invention is that it leads to longer life of the timer. In prior art timers, the movement of finger tips 35 over threads 29, or other portions of shaft 36 that was larger than the fingers, could cause particles to be removed from the tips 35 of fingers 38 in the assembly process. This could cause finger tips 35 to no longer fit snugly into groove 27, which over time could cause failure of the part. Moreover, the particles could remain in the timer after manufacture and interfere with the action, cause wear to various parts and insulate the switches.

In the preferred embodiment, threads 29 are 1/4–20 threads having a major diameter of about 0.25 inches. The diameter of the enlarged portion 23 of shaft 36 is about 0.300 inches, the diameter of groove 27 is about 0.252 inches, and the diameter defined by the tips 35 of fingers 38 is about 0.250 inches. Preferably there are eight fingers 38. Preferably shaft 36 including member 58 and teeth 60 is die cast out of a zinc alloy or other suitable material commonly used for timer shafts and actuator 34 is made of CELCON TM plastic made by Celanese Corporation or other suitable material. Bearing 22 including teeth 60 is molded of glass-filled nylon. There are preferably 12 of teeth 60 equally spaced around a circle of about 0.45 inches in diameter. The critical dimension for proper engaging of the teeth is that of the slots 88 between them which are each $0.045 \pm 0.002$ inches wide. Each tooth is 0.100 inches high and is "sharpened" on its end to a 90° included angle with a 0.020 inch spherical radius. Teeth 62 are preferably each 0.125 inches long and 0.040 inches wide in the thin dimension (which fits in the slots 88 discussed above) and again the ends are sharpened to a 90° included angle (45° each side of the tip) and rounded to a 0.010 inch radius.

A novel timer which is easier to manufacture and more reliable than prior art timers has been described. It is evident that those skilled in the art may now make many uses and modifications of the specific embodiment described without departing from the inventive concepts. Consequently, the invention is to be construed as embracing each and every novel feature and novel combination of features present in the timer described.

What is claimed is:

1. A timing mechanism comprising:

a support;

a camstack, a shaft, first clutch teeth and second clutch teeth all mounted in said support for rotation about a common axis, said shaft movable along said axis between a first position and a second position;

first switch means for contacting said camstack to be actuated thereby; means for mechanically coupling said first clutch teeth to said camstack so that when one rotates the other also rotates;

said second clutch teeth integrally formed with said shaft;

said shaft, said first teeth, and said second teeth located so that when said shaft is in said first position, said first teeth are intermeshed with said second teeth and when said shaft is in said second position said first teeth and said second teeth are disengaged; and intermesh assurance means for causing said first and second teeth to intermesh when said shaft is moved axially from said second position toward said first position no matter what relative rotational position about said axis said shaft is in.

2. A timing mechanism according to claim 1 wherein said intermesh assurance means comprises rounded tips on either said first teeth or said second teeth and wherein said rounded tips are rounded on all sides.

3. A timing mechanism according to claim 2 wherein said rounded tips are spherical.

4. A timing mechanism according to claim 3 wherein said intermesh assurance means further comprises v-shaped ends with rounded leading edges on the other of said first teeth or said second teeth.

5. A timing mechanism according to claim 4 wherein said first teeth and said second teeth are spaced so that said tips and said ends cannot be perfectly aligned with the tip of each of said teeth at the center of the corresponding one of said spherical ends.

6. A timing mechanism according to claim 1 and further comprising second switch means for controlling power to said timing mechanism, and switch actuating means for activating said second switch means, said switch actuating means including an actuator member mounted on said shaft.

7. A timing mechanism according to claim 6 wherein said shaft includes a narrower portion having threads and an enlarged portion having a groove and wherein said switch actuating member includes a resilient means for engaging said groove, said enlarged portion having a diameter greater than the major diameter of said threads and said resilient means having a diameter equal to or greater than the major diameter of said threads and less than the diameter of said enlarged portion whereby said switch actuator member can be slid onto said shaft with said resilient means passing over said threads without damage and engaging said groove in said enlarged portion to couple said actuating member to said shaft.

8. A timing mechanism as in claim 7 wherein said shaft further includes a ramp portion connecting said narrower portion and said enlarged portion.

9. A timing mechanism as in claim 7 wherein said resilient means comprises a plurality of resilient fingers arranged in a circle of diameter greater than or equal to the major diameter of said threads.

10. A timing mechanism as in claim 1 wherein said camstack includes a hollow hub having tangs extending in said hollow hub parallel to said axis, and wherein said timing mechanism further including a bearing mounted in said support and having channels through it, said first clutch teeth are integrally formed with said bearing and said bearing further includes means for mechanically coupling said bearing to said camstack by said tangs passing through said channels.

11. A timing mechanism comprising:

a support;

a camstack rotatably mounted in said support;

first switch means contacting said camstack to be actuated thereby;

second switch means controlling power to said timing mechanism;

a shaft mounted in said camstack; and switch actuating means for activating said second switch means, said switch actuating means including an actuator member mounted on said shaft;

said shaft including a narrower portion having threads and an enlarged portion having a groove and said switch actuating member including a resilient means for engaging said groove, said enlarged portion having a diameter greater than the major diameter of said threads and said resilient means having a diameter equal to or greater than the major diameter of said threads and less than the diameter of said enlarged portion whereby said switch actuator member can be slid onto said shaft with said resilient means passing over said threads without damage and engaging said groove in said enlarged portion to couple said actuating member to said shaft.

12. A timing mechanism as in claim 11 wherein said shaft further includes a ramp portion connecting said narrower portion and said enlarged portion.

* * * * *